United States Patent [19]

Willis

[11] 4,366,762

[45] Jan. 4, 1983

[54] TOOL FOR MAKING TUFTED RUGS AND WALL HANGINGS

[76] Inventor: Grant N. Willis, Seven Sea La., Hilton Head Island, S.C. 29928

[21] Appl. No.: 232,870

[22] Filed: Feb. 9, 1981

[51] Int. Cl.[3] ..... D05C 15/06

[52] U.S. Cl. ..... 112/80

[58] Field of Search ..... 112/80; 139/1

[56] References Cited

U.S. PATENT DOCUMENTS

| | | | |
|---|---|---|---|
| 2,672,109 | 3/1954 | Wilson | 112/80 |
| 2,873,766 | 2/1959 | Jeandupeux | 139/1 |
| 3,230,982 | 1/1966 | Sims | 112/80 X |
| 3,467,145 | 9/1969 | Jeandupeux | 139/1 R |
| 4,006,694 | 2/1977 | Thaheld et al. | 112/80 |
| 4,011,823 | 3/1977 | Houghton | 112/80 |
| 4,267,784 | 5/1981 | Heemstra | 112/80 |

*Primary Examiner*—Ronald Feldbaum

*Attorney, Agent, or Firm*—Prutzman, Kalb, Chilton & Alix

[57] ABSTRACT

A hand operated tool is provided for attaching tufts of yarn to a canvas backing. The tool has an elongated housing at the front of which is attached a wire loop with a bight of the loop spaced forwardly of the housing and extending transversely to the longitudinal axis of the housing. A pair of clamps at the front of the housing are adapted to clamp a length of yarn which has been looped around the base of the wire loop by the operator. An elongated needle is mounted in the housing for sliding movement in alignment with the clamps and bight of the wire loop. A trigger mechanism is provided for closing the clamps about the yarn and a rearwardly extending plunger is provided for advancing the tip of the needle through the clamp and the bight of the wire loop. Optionally, a cutter and yarn guide assembly may be adjustably mounted on the housing through which the operator can feed a length of yarn preparatory to pulling it around the base of the wire loop and which operates to sever the doubled length of yarn to form a tuft of desired length.

14 Claims, 16 Drawing Figures

TOOL FOR MAKING TUFTED RUGS AND WALL HANGINGS

This invention relates to the art of making throw rugs and wall hangings and is concerned, more particularly, with a new and improved hand operated tool for use by hobbyists and other devotees of needlework for attaching tufts of yarn to a canvas backing.

In a conventional hand method of making throw rugs and wall hangings, pieces of pre-cut yarn of the order of 2½ to 4 inches in length are fastened as tufts to a canvas backing. The canvas backing is usually a sheet of open weave fabric which has been sized to impart stiffness and which is formed with parallel rows of relatively large rectangular interstices or apertures of the order of one-fourth inch square. To fasten the pre-cut pieces of yarn to the canvas, each piece of yarn is folded double and the free ends are inserted downwardly through one fabric aperture and then upwardly through a next adjacent aperture to cause it to wrap around the cross strand of the fabric between the two apertures. The loop of yarn is anchored in place by passing the free ends through the bight of the loop and pulling it taut. A so-called latch hook is available for use in achieving the attachment of the pieces of yarn to the canvas, but the process as heretofore carried out is tedious and time consuming and needlessly expensive because of the requirement that pre-cut yarn be used.

Accordingly, it is a principal object of the present invention to provide a new and improved tool for securing tufts of yarn to a canvas backing with the same type of lock switch as previously used but whereby this may be done more rapidly and easily.

A further object of the invention is to provide such a tool which is hand operated and which is simple to use with a minimum of skill and instruction and which may be depended upon to perform the desired accurate and secure locking of the yarn tufts to the canvas.

Another object is to provide such a tool which is rugged in design so that it can be used over long periods of time without repair or replacement and which, at the same time, is comprised of easily fabricated parts and easily assembled whereby the tool may be manufactured and marketed at reasonable cost.

An additional object is to provide a tool of the type referred to which does not require the use of pre-cut yarn but may be employed with the much less expensive skein yarn which is readily available. Included in this aim is the provision of means for quickly and easily varying the length of the tufts which are secured to the canvas whereby rugs or hangings of various thickness or depth can be obtained and also whereby sculpture designs produced by using tufts of varying length can be easily attained.

Other objectives will be in part obvious and in part pointed out in more detail hereinafter.

A better understanding of the invention will be obtained from the following description and the accompanying drawings of an illustrative embodiment of the invention.

DESCRIPTION OF THE PREFERRED EMBODIMENT

Figure 1:
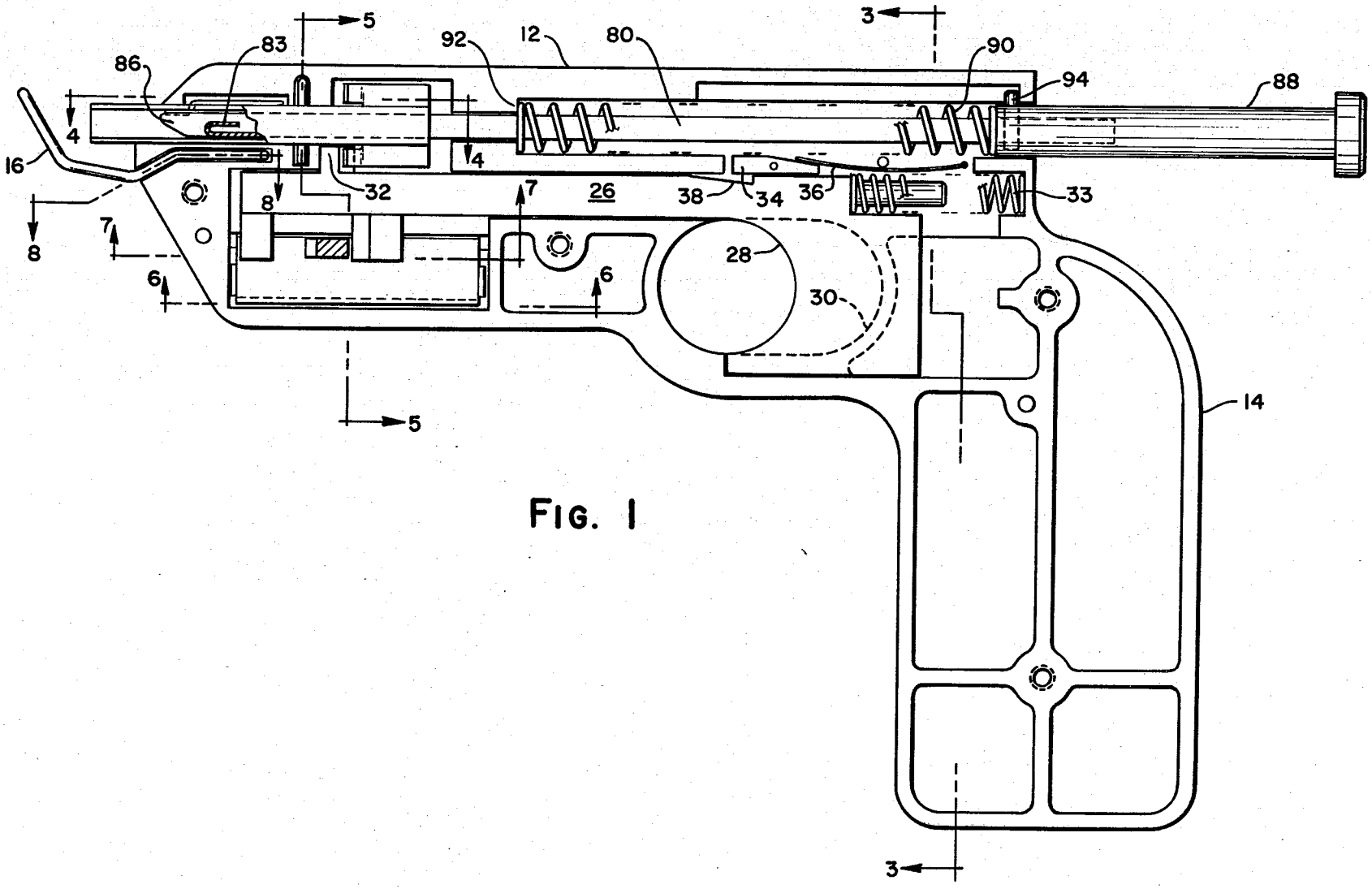
FIG. 1 is a side view, partially in section, of a tool embodying the invention with the cutter and yarn guide assembly removed and with the left hand housing member removed to show the internal working parts in the normal at rest position.
Figure 2:
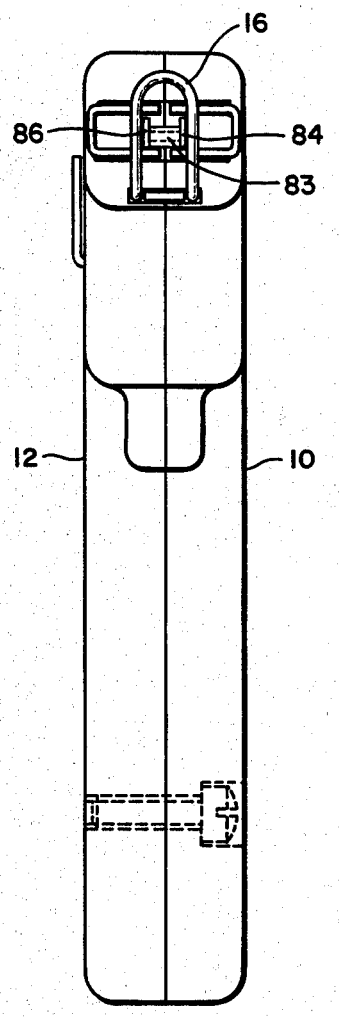
FIG. 2 is a front end view of the tool as shown in FIG. 1.
Figure 3:
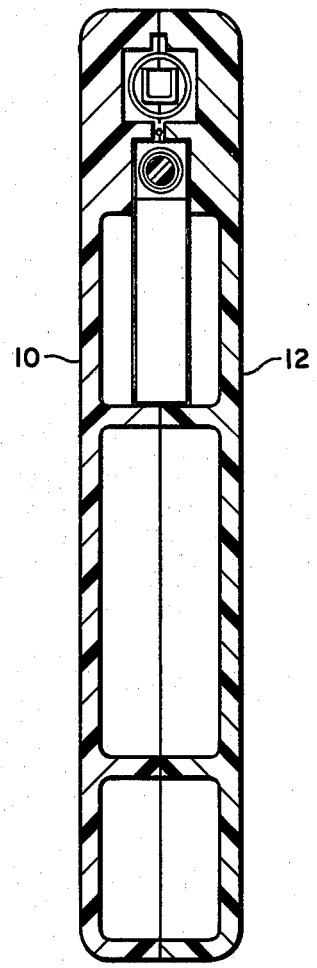
FIG. 3 is a cross-sectional view taken along the line 3—3 in FIG. 1.

Referring to the drawings in detail, the housing of the tool exemplifying my invention comprises left and right housing members 10,12 which are substantially mirror images of each other and when secured together in mating relationship form a rigid housing. Depending legs at the rear of the housing members form a handle 14 of the pistol grip type by means of which the tool may be held by the operator.

Figure 4:
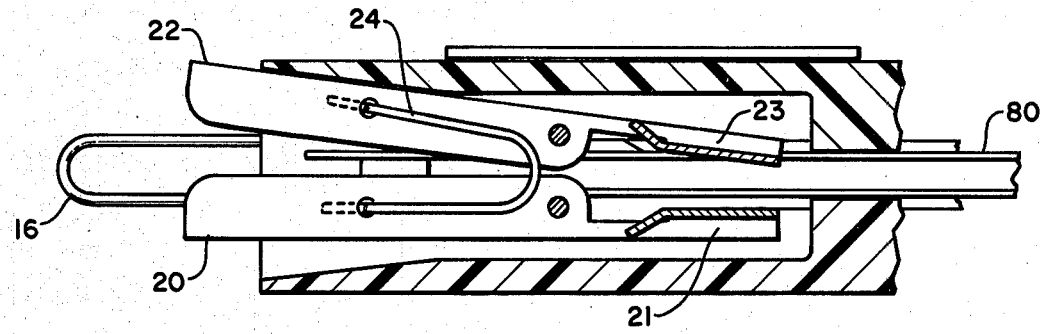
FIG. 4 is a cross-sectional view taken along the line 4—4 in FIG. 1 with the left hand clamp shown in yarn clamping position which occurs when the trigger mechanism is actuated and with the right hand clamp shown in yarn releasing position which occurs when the trigger mechanism is released.
Figure 8:
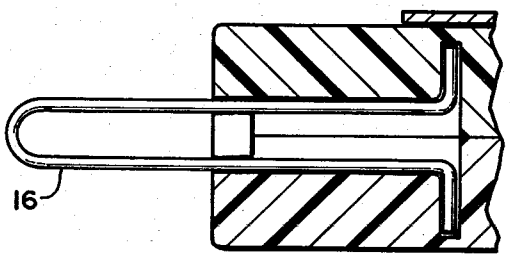
FIG. 8 is a cross-sectional view taken along the line 8—8 in FIG. 1.
Figure 11:
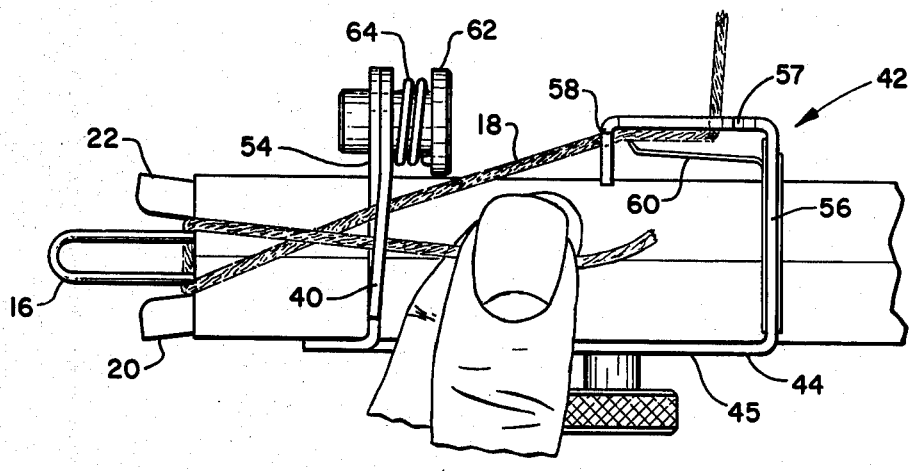
FIG. 11 is a fragmentary top view of the tool with a section of yarn threaded through the cutter and yarn guide assembly and extending around the base of the nose loop and being held in place between the forefinger and thumb of an operator preparatory to operation of the tool.
Figure 12:
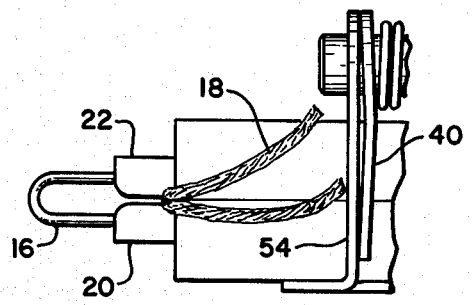
FIG. 12 is a similar fragmentary top view of the tool showing the yarn after it has been clamped and cut to size.
Figure 13:
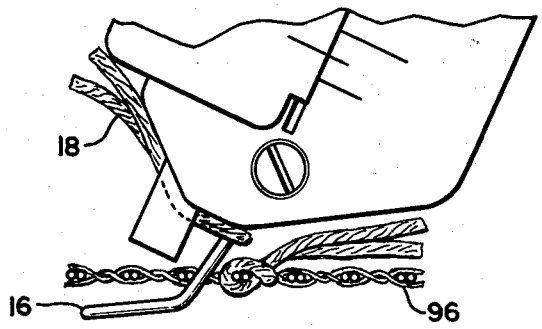
FIG. 13 is a fragmentary left side view of the tool with a loop of yarn clamped to the nose loop and with the nose loop inserted through an opening in a piece of canvas backing shown in cross-section and having a previously formed tuft attached thereto through adjacent openings in the canvas.

Mounted at the forward end of the housing is a nose loop 16 formed of stiff wire and shaped as best shown in FIGS. 1 and 8. The configuration is such that the forward end or bight of the loop 16 extends upwardly in front of the tool transversely to its longitudinal axis. As described more fully hereinafter, nose loop 16 is one of the parts which function to secure a tuft of yarn to the canvas when the tool is operated. When the tool is to be used, a short length of skein yarn indicated by reference numeral 18 is manually looped around the base of the nose loop 16 and drawn upwardly over the front of the housing as shown in FIG. 11. Pivotally mounted in the housing and extending forwardly from the housing above the base of the nose loop 16 and aligned with the opening formed by the bight of the nose loop 16 are a pair of clamps 20,22 best shown in FIG. 4. The forward ends of clamps 20,22 gave opposed c-shaped cross sections forming a channel therebetween and are adapted, when the forward ends are pivoted together as shown in FIGS. 12 and 13, to engage and clamp between them the doubled portion of the yarn 18 which has previously been looped around the nose loop 16. Reversely, when the forward ends of the clamps 20,22 are pivoted apart as shown in FIG. 11, the yarn is released and the clamps are out of the way so that they will not interfere with the placement of the loop of yarn 18 around the nose loop 16 by the operator.

The clamps 20,22 are biased to the normally open position shown in FIG. 11 by a hairpin type spring 24 and may be actuated to the closed clamping position shown in FIG. 12 by trigger means comprising the elongated slide 26 mounted for sliding movement longitudinally within the tool housing. The slide 26 has a depending finger piece 28 registering with the through opening 30 in the tool housing whereby the finger piece 28 may be engaged by the trigger finger of the operator and pulled rearwardly to actuate the slide 26. Located at the forward end of slide 26 is an upstanding lug 32 which extends between rear cam portions 21,23 of the clamps 20,22 whereby when the trigger slide 26 is pulled rearwardly, the lug 32 spreads the cam portions 21,23 apart thereby closing the forward ends of the clamps 20,22. When the trigger slide 26 is pulled rearwardly, it is caught and held in the rearward actuated position by a detent 34 which is biased by a leaf spring 36 to engage with the notch 38 in the top surface of slide 26. Thus when the slide 26 is retracted, it is retained in actuated position holding the clamps 20,22 in yarn clamping position until released by means to be described below.

Another function of the trigger slide 26 is to operate the bell crank shaped blade 40 pivotally mounted on the cutter and yarn guide assembly indicated generally at 42. The cutter and yarn guide assembly comprises a frame 44 having a downwardly extending side wall 45 terminating in an inwardly turned flange 46 which is engaged in a longitudinal groove 48 in the outer surface of the left housing member 10. The groove 48 is longer than the flange 46 whereby the frame 44 may be moved forwardly or rearwardly within limits to a selected position longitudinally of the housing. The frame is held in adjusted position by a clamping knob 50 having a threaded shank (not shown) which extends through a slot 52 in the frame side wall 45 into threaded engagement with the housing member 10.

The upper portion of side wall 45 has a forward transverse extension 54 and a generally L-shaped rear transverse extension 56, both of which extend across the top of the housing when the cutter and yarn guide assembly 42 is in place. The extension 56 has a rear guide slot 57 and a front guide slot 58 through which the yarn 18 is threaded and where the yarn 18 is engaged by a snubbing spring 60 which yieldingly bears against the yarn 18 and maintains it under tension as the operator pulls the end of the yarn forwardly and wraps it around the base of the nose loop 16 as previously described.

Figure 5A:
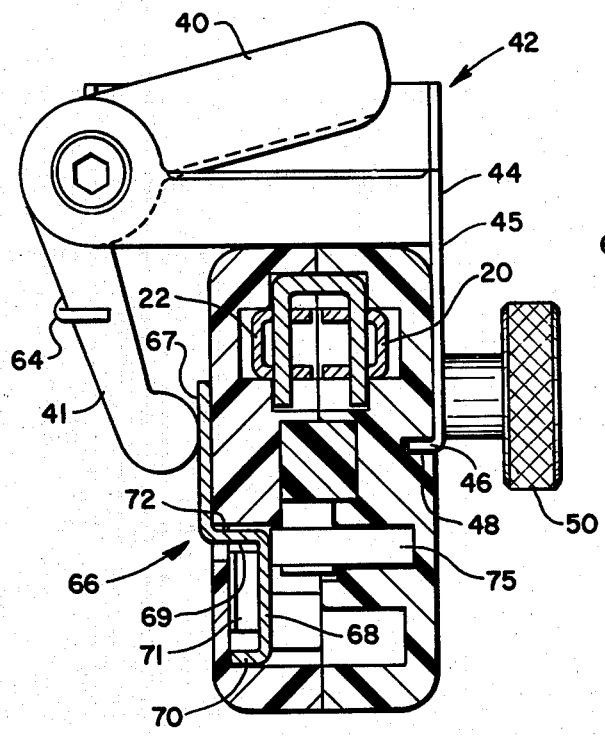
FIG. 5*a* is a cross-sectional view taken along line 5—5 in FIG. 1 and with the trigger mechanism in the released position shown in FIG. 1.
Figure 5B:
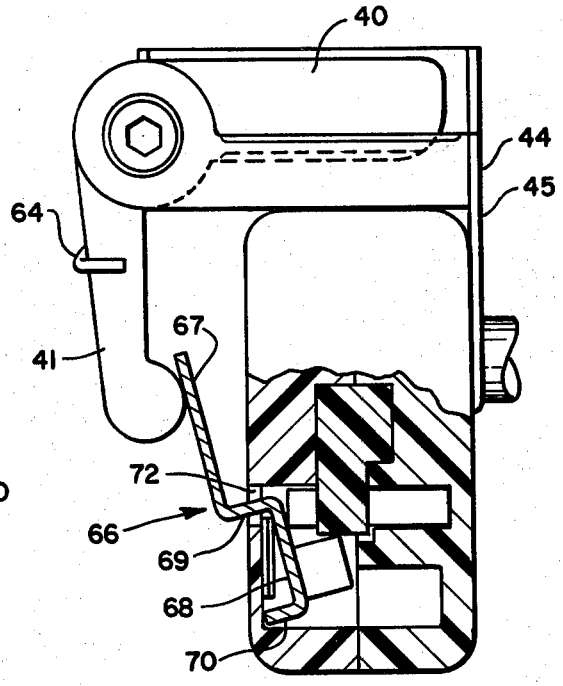
FIG. 5*b* is a cross-sectional view similar to FIG. 5*a* except that the trigger is in rearward locked actuated position.
Figure 6:
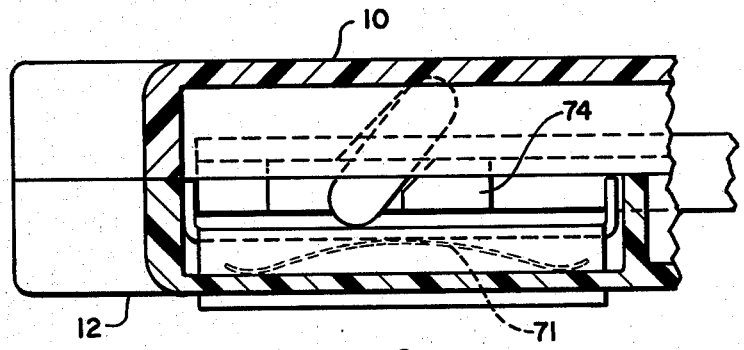
FIG. 6 is a cross-sectional view taken along the line 6—6 in FIG. 1.

The forward extension 54 of the frame 44 provides a pivot 62 at its outer end for the hub of the bell crank blade 40 which is biased in a counterclockwise direction as viewed in FIGS. 5*a* and 5*b* by a torsion spring 64. When the blade 40 is turned in a clockwise direction as viewed in FIGS. 5*a* and 5*b* the cutting edge portion 42 thereof functions to sever the yarn 18 where it extends over the upper edge of frame extension 54.

The blade 40 is actuated in a clockwise direction to perform a cutting operation by a lever plate 66 having upper and lower offset portions 67 and 68 interconnected by a web 69 and having an inwardly turned flange 70 at its bottom end. As best shown in FIGS. 5*a* and 5*b*, the lower portion 68 of the plate 66 is disposed in a cavity within the housing for pivoting movement around the flange 70. The web 69 extends through a slot 72 in the wall of the right housing member and the upper portion of the plate 66 engages the depending arm 41 of the cutter blade 40. The plate 66 is biased to the retracted position shown in FIG. 5*a* by a leaf spring 71. The lever plate 66 is sufficiently wide so that it will always engage the arm 41 regardless of the adjusted position of the cutter and yarn guide assembly 42 longitudinally of the housing .

Figure 7:
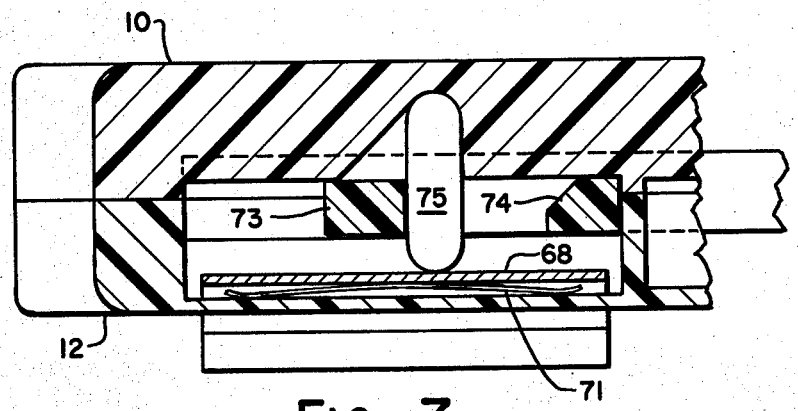
FIG. 7 is a cross-sectional view taken along the line 7—7 in FIG. 1.
Figure 10:
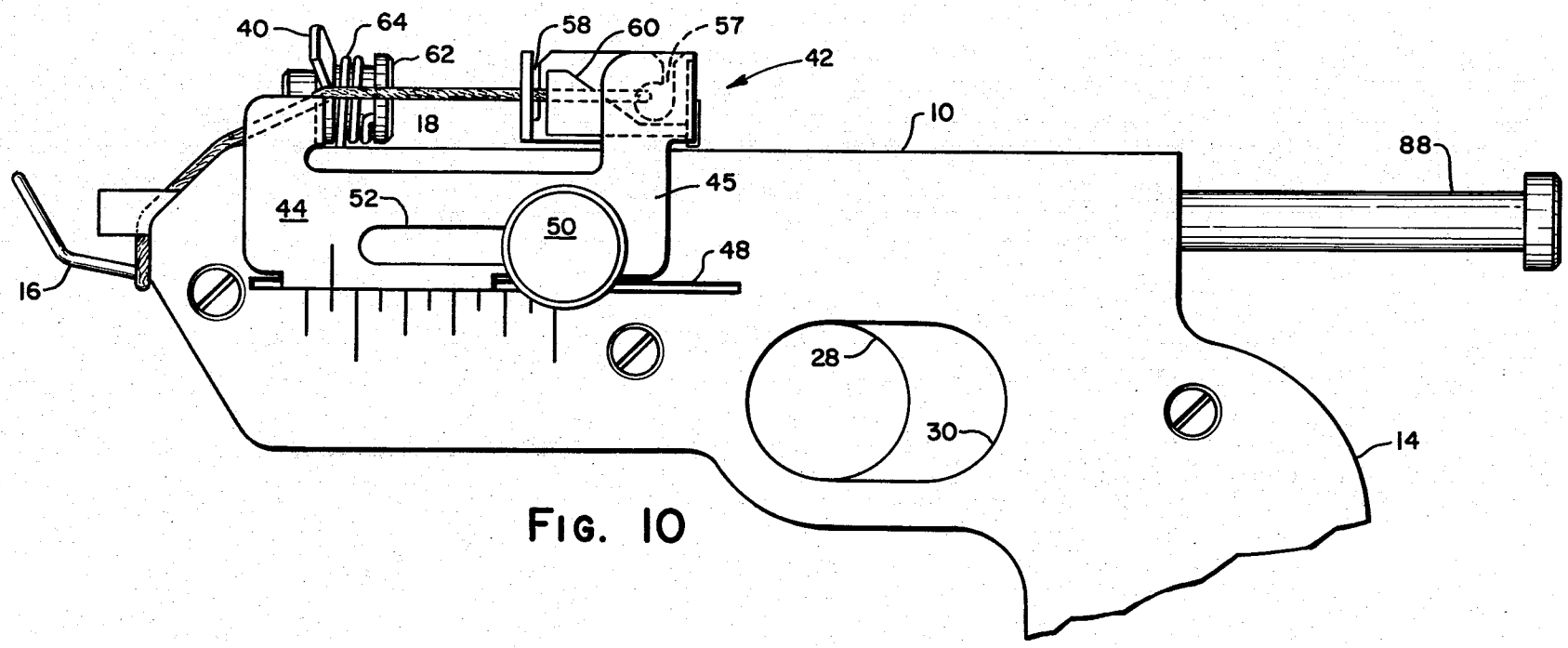
FIG. 10 is a fragmentary left side view of the tool with the cutter and yarn guide assembly attached and with a section of yarn threaded through the cutter and yarn guide assembly and extending around the base of the nose loop.
Figure 9:
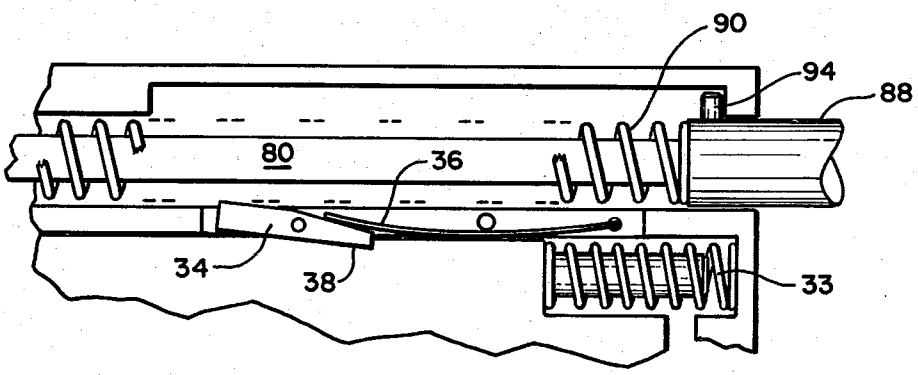
FIG. 9 is a fragmentary view similar to FIG. 1 but with the trigger mechanism in rearward locked actuated position.

The lever plate 66 is pivoted in a counterclockwise direction as viewed in FIGS. 5*a* and 5*b* to actuate the cutter blade 40 by the trigger member 26 through the intermediary of a link 75 which as best shown in FIGS. 5*a* through 7 extends through a notch 27 in the trigger sliding member 26. The link 75 is adapted to pivot about its right hand end as viewed in FIGS. 5*a* and 5*b* which seats against the interior of the wall of the left housing member 10. The other end of link 75 engages against the top of the lower portion 68 of the lever plate 66 adjacent the web 69. As will be apparent, when the trigger sliding member 26 is pulled rearwardly by the operator, the abutment 73 at the front of the notch 27 will engage and pivot the link 75 to a position at right angles to the lever plate 66 as best shown in FIGS. 5*b* and 7 thus pivoting the lever plate 66 in a counterclockwise direction as viewed in FIGS. 5*a* and 5*b*, thereby actuating the cutter blade 40. When the trigger sliding member 26 is returned to starting forward position, the rear abutment 74 engages the link 75 and returns it to the position shown in FIGS. 5*a* and 6 which permits the lever plate 66 to retract under the influence of spring 71.

Figure 14:
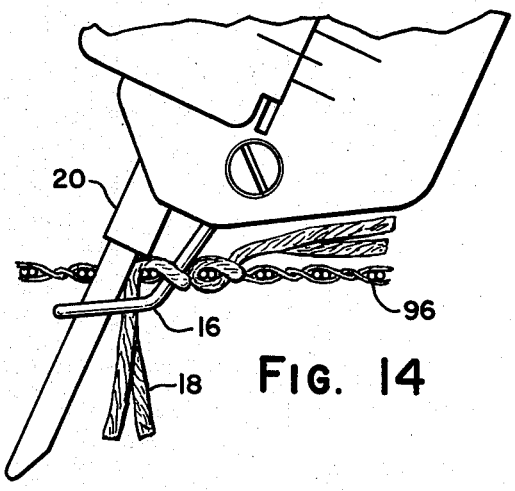
FIG. 14 is a view similar to FIG. 13 but showing the tool after the plunger has been actuated.

Mounted for longitudinal sliding movement within the housing in alignment with the opening between the clamps 20,22 is an elongated needle 80 which is U-shaped in cross-section. The center transverse portion of the needle is reversely bent at the front end or tip as indicated at 83 to bifurcate the front end and form two prongs 84,86 which are tapered inwardly at their forward edges as best shown in FIGS. 1 and 14. The needle 80 is dimensioned in cross-section so that it can slide forwardly through an opening or channel afforded between the closed clamps 20,22 as a result of their cross-sectional configuration. The design of the front end or tip of the needle 80 is such that the prongs 84,86 will straddle the yarn 18 which is held between clamps 20,22 as the needle is moved frowardly and will carry this forwardly toward and through the bight of the nose loop 16.

The needle is connected at its rear end to a plunger 88 which extends through the rear wall of the housing and rearwardly of the tool where it can be pushed inwardly by the thumb of the operator while grasping the handle 14. A compression spring 90 disposed between the base of the plunger 88 and the housing abutment 92 normally maintains the plunger 88 and needle in the retracted position with the stop pin 94 against the rear wall of the housing as shown in FIG. 1. When the plunger 88 is pushed inwardly by the operator a sufficient distance to cause the forward end of the plunger to engage the detent 34 this will cause the detent 34 to pivot out of the notch 38 thereby releasing the trigger sliding member 26 and permitting it to move forwardly to its original position under the influence of the compression spring 33.

It is believed that the operation of the tool will be apparent from the foregoing detailed description of the tool taken together with the following explanation with particular reference to FIGS. 11 through 15 of the drawing. As indicated in FIG. 11, the first step is to draw the skein yarn through the guide slot 57, under the tension spring 60, and then through guide slot 58 of the cutter and yarn guide assembly 42 and loop it around the base of the nose loop 16. It is assumed that a longitudinal position of the cutter and yarn guide assembly 42 has been selected so as to produce the desired tuft length. It will be noted that indicia is provided along the groove 48 to facilitate the desired setting of the cutter and yarn guide assembly 42. It will be appreciated, however, that the operator is not restricted to utilizing a single setting of the cutter and yarn guide assembly 42 but may change this at will to produce a rug or wall covering having a so-called sculptured pattern. It also will be appreciated that although skein yarn is the most economical to use, the operator is not precluded from using pre-cut yarn if that is desired. When pre-cut yarn is used, the cutter and yarn guide assembly is not needed and may be dispensed with by unscrewing the knob 50 and removing the assembly from the housing.

The operator will normally hold the tool by grasping the handle 14 with his right hand and will locate the yarn 18 using the forefinger and thumb of the left hand as indicated in FIG. 11. The next step for the operator to perform is to pull the trigger finger piece 28 which closes the clamps 20,22 on the yarn and operated the cutter blade 40 to sever the yarn at the desired length which is the condition shown in FIG. 12. The operator then inserts the nose loop 16 through one of the interstices of a canvas backing 96 and holds the tool with the bight of the loop 16 aligned with the next adjacent interstice of the canvas backing as shown in FIG. 13. When this has been accomplished, the operator then pushes the plunger 88 inwardly to cause the needle 80 to engage the ends of the yarn 18 engaged by the clamps 20,22 and push them through the said adjacent interstice of the canvas and through the bight of the nose loop 16 as depicted in FIG. 14.

Figure 15:
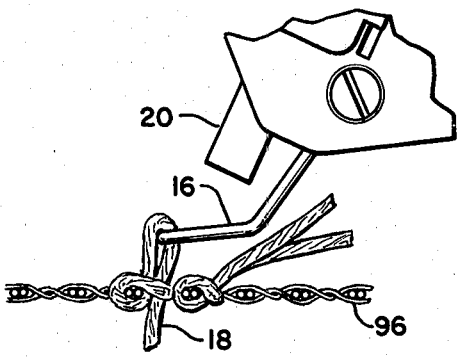
FIG. 15 is a view similar to FIGS. 13 and 14 after the plunger has been released and the nose loop has been withdrawn from the fabric to pull the free ends of the yarn loop through the bight of the loop just prior to completing the lock stitch.

This movement of the plunger 88 releases the trigger sliding member 26 permitting the member 26 to return to the forward starting position under the influence of spring 33 thereby opening and releasing the clamps 20,22 from their engagement with the yarn. The final step to be performed by the operator is to release the plunger 88 and withdraw the nose loop 16 from the canvas which causes the free ends of the yarn tuft to be pulled uupwardly through the canvas and through the bight of the folded yarn thereby locking the yarn tuft to the canvas as indicated in FIG. 15. The operations as thus described are then repeated at the additional openings of the canvas until the desired area of the canvas has been covered.

As will be appreciated, the tool of the present invention makes it possible to secure tufts of yarn to a canvas backing in a simple operation with minimum skill and instruction and to accomplish this at a far faster rate and with less tedium than heretofore possible. The tool also has the further advantage of permitting the use of skein yarn rather than the more expensive pre-cut yarn which has been required previously.

As will be apparent to persons skilled in the art, various modifications, adaptations and variations of the foregoing specific disclosure can be made without departing from the teachings of the present invention.

I claim:

1. A hand operated tool for attaching tufts of yarn to a woven backing sheet comprising an elongated housing having a depending pistol grip at its rear end, a wire loop attached to the front of the housing with the bight of the loop spaced from the front of the housing and extending transversely to the longitudinal axis of the housing, a pair of pivotally mounted clamps at the front of the housing for holding a loop of yarn which has been wrapped around the wire loop close to the housing, an elongated needle mounted in the housing for longitudinal movement in alignment with the clamping means and the bight of the wire loop, the clamps being oppositely channelled in cross-section to permit the needle to pass therethrough, the needle having a bifurcated tip for engaging ends of a loop of yarn held by the clamping means and transport them through the bight of the wire loop as the needle is moved forwardly, a longitudinally movable slide mounted in the housing and having a depending trigger forwardly of the handle whereby the slide may be pulled rearwardly of the housing, the slide having means for closing the clamps when the slide is pulled rearwardly, a plunger attached to the needle and extending rearwardly from the rear end of the housing for engagement by the thumb of the operator to move the needle forwardly and carry the ends of the loop of yarn from the clamps through the bight of the wire loop.

2. A tool as defined in claim 1 wherein the slide is spring biased forwardly of the housing, the needle and plunger are spring biased rearwardly of the housing, detent means is provided to retain the slide in rearward retracted position when the slide is moved rearwardly by the operator, and cam means is provided to release the detent when the plunger and needle are moved to the forward actuated position by the operator.

3. A tool as defined in claim 1 or 2 wherein a cutter and yarn guide assembly is provided, said assembly comprising a frame mounted on the top of the housing at the front end thereof and adjustable longitudinally of the housing, a knife pivotally mounted on the frame, and lever means between the knife and slide operable to pivot the knife in a yarn cutting direction when the slide is pulled rearwardly by the operator.

4. A tool as defined in claim 3 wherein the frame of the cutter and yarn guide assembly has a pair of spaced apart slots through which a length of yarn may be threaded and spring means for engaging a length of yarn threaded through the slots and holding the yarn in tension as it is pulled therethrough.

5. A hand operated tool for attaching tufts of yarn to a woven backing sheet comprising a housing, a wire loop attached to the front of the housing with the bight of the loop spaced from the front of the housing and extending transversely to the longitudinal axis of the housing, manually operable clamping means at the front of the housing for holding the ends of a tuft of yarn which has been wrapped around the wire loop close to the housing, an elongated needle mounted on the housing for longitudinal movement in alignment with the clamping means and the bight of the wire loop, the needle having a tip for engaging and retaining a tuft of yarn held by the clamping means, and manually operable means for moving the needle forwardly of the housing to transfer the ends of a tuft of yarn from the clamping means through the bight of the wire loop.

6. A tool as defined in claim 5 wherein the clamping means comprises a pair of opposed clamps which are channelled in cross-section thereby providing a through passageway, and the needle is dimensioned to pass longitudinally through the said passageway.

7. A tool as defined in claim 6 wherein the forward tip of the needle is bifurcated to engage and retain the ends of a loop of yarn held between the pair of clamps when the needle is passed longitudinally therethrough.

8. A tool as defined in claim 5 or 6 wherein the housing is provided with a pistol grip handle at its rear end and the means for moving the needle forwardly is a plunger attached to the needle and extending rearwardly from the rear end of the housing.

9. A tool as defined in claim 5 or 6 wherein the housing is provided with a pistol grip handle at its rear end and means for actuating the clamping means in a closing direction comprises a slide mounted for longitudinal sliding movement within the housing and having a depending trigger located forwardly of the handle.

10. A tool as defined in claim 5 or 6 in which the clamping means is actuatable by a manually retractable slide, a detent is provided to hold the slide in retracted position, the manually operable means for moving the needle forwardly comprises a plunger attached to the needle and extending rearwardly from the rear end of the housing, and means is provided on the plunger for releasing the detent when the needle is in fully advanced position.

11. A tool as defined in claim 10 wherein the housing has a pistol grip handle depending from the rear end thereof and the slide has a depending trigger located forwardly of the handle.

12. A tool as defined in claim 5 wherein a cutter mechanism is provided on the housing at the front end thereof for cutting a piece of yarn which has been looped around the wire loop at the front of the housing and brought over the top of the housing by the operator.

13. A tool as defined in claim 12 wherein a manually retractable slide is provided for closing the clamping means and operating the cutter mechanism.

14. A tool as defined in claim 12 wherein the cutter mechanism comprises a pivoted knife which is mounted on top of the housing at the front end thereof and which is adjustable longitudinally of the housing to vary the length of a tuft of yarn cut thereby.

* * * * *